United States Patent [19]

Leifeld et al.

[11] Patent Number: 4,817,247

[45] **Date of Patent: * Apr. 4, 1989**

[54] LAP LEVELER FOR A TEXTILE FIBER PROCESSING MACHINE

[75] Inventors: Ferdinand Leifeld, Kempen; Franz J. Nohr, Jüchen, both of Fed. Rep. of Germany

[73] Assignee: Trützschler GmbH & Co. KG, Mönchengladbach, Fed. Rep. of Germany

[ * ] Notice: The portion of the term of this patent subsequent to Nov. 22, 2005 has been disclaimed.

[21] Appl. No.: 100,334

[22] Filed: Sep. 23, 1987

[30] Foreign Application Priority Data

Sep. 25, 1986 [DE] Fed. Rep. of Germany ..... 3632581
Jul. 4, 1987 [DE] Fed. Rep. of Germany ..... 3722141

[51] Int. Cl.[4] ..... D01H 5/38
[52] U.S. Cl. ..... 19/105; 19/240
[58] Field of Search ..... 19/105, 240

[56] References Cited

U.S. PATENT DOCUMENTS 4,161,052 7/1979 Erben ..... 19/240
4,506,413 3/1985 Leifeld ..... 19/105
4,520,531 6/1985 Hergeth ..... 19/105

FOREIGN PATENT DOCUMENTS 1952829 4/1970 Fed. Rep. of Germany .
2905589 8/1980 Fed. Rep. of Germany .
3543933 4/1987 Fed. Rep. of Germany .
2322942 4/1977 France .
1594432 7/1981 United Kingdom .
2138578 10/1984 United Kingdom .

*Primary Examiner*—Louis K. Rimrodt
*Attorney, Agent, or Firm*—Spencer & Frank

[57] ABSTRACT

An apparatus for levelling the thickness of a running fiber lap fed to a textile fiber processing machine, includes a feed roller having a generally horizontal longitudinal axis and a feed table cooperating with the feed roller by defining therewith a nip through which the fiber lap passes. The fiber processing machine further includes a motor connected with the feed roller for rotating the feed roller, a lap thickness measuring device including a sensor element cooperating with the feed roller and undergoing excursions in response to thickness variations of the fiber lap runing between the feed roller and the sensor element and a control device connected to the measuring device for receiving signals representing the excursions. The control device is connected to the motor for applying rpm control signals thereto as a function of the thickness variations. The sensor element is separate from, and is movable relative to, the feed table, and the feed table has an aperture, and the sensor element cooperates with the feed roller through the aperture.

21 Claims, 5 Drawing Sheets

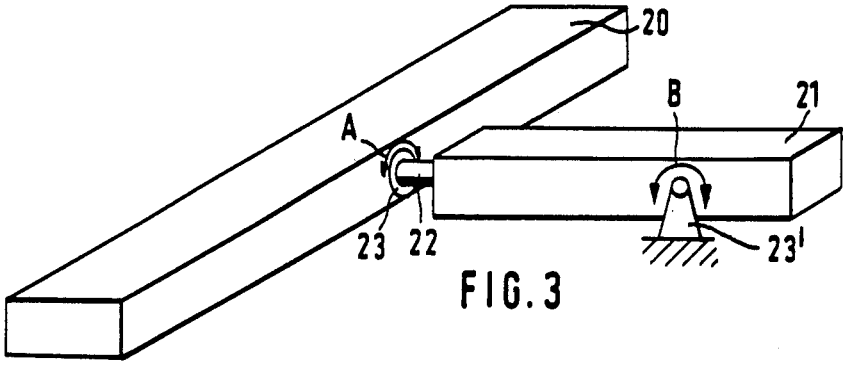
FIG. 3
FIG. 3a
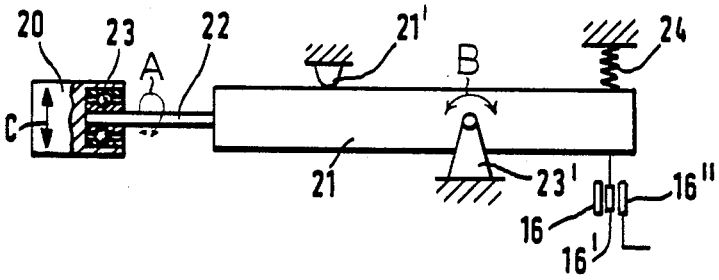
FIG. 3b
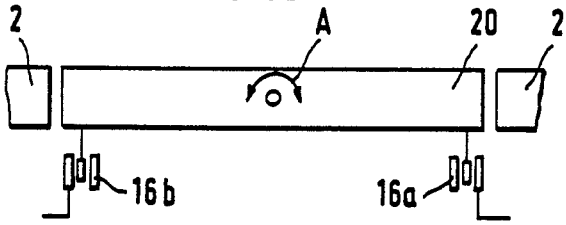

1
1b
2
2c
2d
2e
2f
2g
2h
16a
16b
20a
20b
21a
21b
32a
32b
33a
33b
34a
34b
36
37a
37b
38b
39a
39b
40a
40b
41a
41b
42a
42b
43a
43b
44a
44b
45
46
F
G

LAP LEVELER FOR A TEXTILE FIBER PROCESSING MACHINE

BACKGROUND OF THE INVENTION

This invention relates to an apparatus for evening (levelling) the fiber lap fed to a textile fiber processing machine such as a card, a roller card unit or the like, having a licker-in, a feed roller arranged upstream of the licker-in as viewed in the direction of material feed and a feed table cooperating with the feed roller. The levelling apparatus includes a measuring member for sensing the thickness of the fiber material drawn into the fiber processing machine and a control device which receives signals from the measuring member and which is connected with the drive motor for the feed roller for regulating the rpm of the latter as a function of the sensed thicknesses.

In an apparatus of the above-outlined type, as disclosed, for example, in French Pat. No. 2,322,942, underneath the stationarily supported feed roller there is provided a stationary support on which a plurality of sensor levers (feed table) are movably held. One end of each sensor lever is in the immediate vicinity of the licker-in and is spring-biased against the feed roller. The other end of each sensor lever is coupled to a measuring device which senses and integrates the displacements of the sensor levers as they move dependent upon the thickness of the fiber material which passes through.

It is a disadvantage of the above-outlined arrangement that as the fiber material is being taken over from the feed roller by the licker-in, the working forces (tearing forces) of the licker-in have an effect on each sensor lever and consequently, the measuring results may be distorted. It is a further disadvantage of such a prior art arrangement that the location of measurement in the nipping zone (clamping zone) between the feed roller and the sensor lever extends over a relatively long region (from the beginning of the nipping zone to the end of the sensor lever) in which the feed roller is essentially facing the sensor lever and, as a result, the measuring location is not unequivocally determined. In this arrangement the feed table is formed of a great number of spring-biased sensor levers which are coupled to a "piano key" system which is structurally very complex.

SUMMARY OF THE INVENTION

It is an object of the invention to provide an apparatus of the above-outlined type with which the discussed disadvantages are eliminated and which, with particularly simple means prevents undesired forces from being applied to the measuring member and by means of which the measuring location can be unequivocally determined.

These objects and others to become apparent as the specification progresses, are accomplished by the invention, according to which, briefly stated, the apparatus for levelling the thickness of a running fiber lap fed to a textile fiber processing machine, includes a feed roller having a generally horizontal longitudinal axis and a feed table cooperating with the feed roller by defining therewith a nip through which the fiber lap passes. The fiber processing machine further includes a motor connected with the feed roller for rotating the feed roller, a lap thickness measuring device including a sensor element cooperating with the feed roller and undergoing excursions in response to thickness variations of the fiber lap running between the feed roller and the sensor element and a control device connected to the measuring device for receiving signals representing the excursions. The control device is connected to the motor for applying rpm control signals thereto as a function of the thickness variations. The sensor element is separate from, and is movable relative to, the feed table, and the feed table has an aperture, and the sensor element cooperates with the feed roller through the aperture.

By virtue of the fact that the feed table is arranged between the sensor element of the measuring member and the licker-in, a distance is provided between the measuring location and the licker-in.

It is an advantage of this arrangement that while the licker-in may exert a force on the fiber material supported by the feed table, there will be no adverse effect on the fiber material lying on the sensor element, particularly at the measuring location. It is a further advantage of the invention that the measuring location extends in the clamping (nipping) zone between the sensor element of the measuring member and the feed roller over a very short region or only over a line extending parallel to the axis of the feed roller or even only over a dot-like area. In this manner, in contradistinction to prior art arrangements, the position of the measuring location may be positively determined whereby a constant path between the measuring location and the transfer location of the fiber material to the licker-in (working location) is ensured.

Dependent upon whether, as a result of the rpm regulation more or less fiber material reaches the working location, the licker-in takes over a greater or lesser amount of fiber material. By virtue of the fact that the sensor element is independent from the feed table, the structure of the apparatus is significantly simplified.

According to a further feature of the invention, the aperture is constituted by a cutout which is provided in the feed table and which may be closed on each side or may be open at one side (that is, at one of the short outer edges). Preferably, the cutout is rectangular wherein the long edges of the cutout extend parallel to the width of the feed table (that is, parallel to the feed roller axis). According to a further feature of the invention the measuring member comprises a rectangular sensor element whose long edges extend parallel to the width of the feed table while its short edges are oriented perpendicularly to the direction of material feed (working direction). By virtue of such a design measurements at several measuring locations may be performed in a structurally simple manner simultaneously over the width of the fiber material with a simultaneous summation (integration) of the measuring values.

According to a preferred embodiment of the invention, two to four sensor elements are provided which is a structurally simple solution and which permits the integration of several measuring values over wide sensor elements.

According to advantageous further features of the invention, the outer end of the sensor element extends approximately as far as the vertical axial plane of the feed roller as viewed in the direction of the licker-in;

the sensor element is supported on a stationary rotary bearing;

the rotary bearing cooperates with a force-exerting element, such as a counterweight or a spring;

the sensor element is vertically displaceably supported;

the sensor element is resiliently supported at its two opposite outer ends;

the sensor element is supported on a holding member;

the sensor element is supported for rotation about a horizontal axis;

the sensor element or the support member has at least one plunger core (armature) with a plunger coil; and the measuring element of the measuring member is an analog, no-contact distance sensor.

BRIEF DESCRIPTION OF THE DRAWING

FIG. 3 is a perspective view of further details of the preferred embodiment.

FIG. 3*a* is a schematic side elevational view of the structure shown in FIG. 3, illustrating further details.

FIG. 3*b* is a schematic front elevational view of FIG. 3*a*.

DESCRIPTION OF THE PREFERRED EMBODIMENTS

Figure 1:
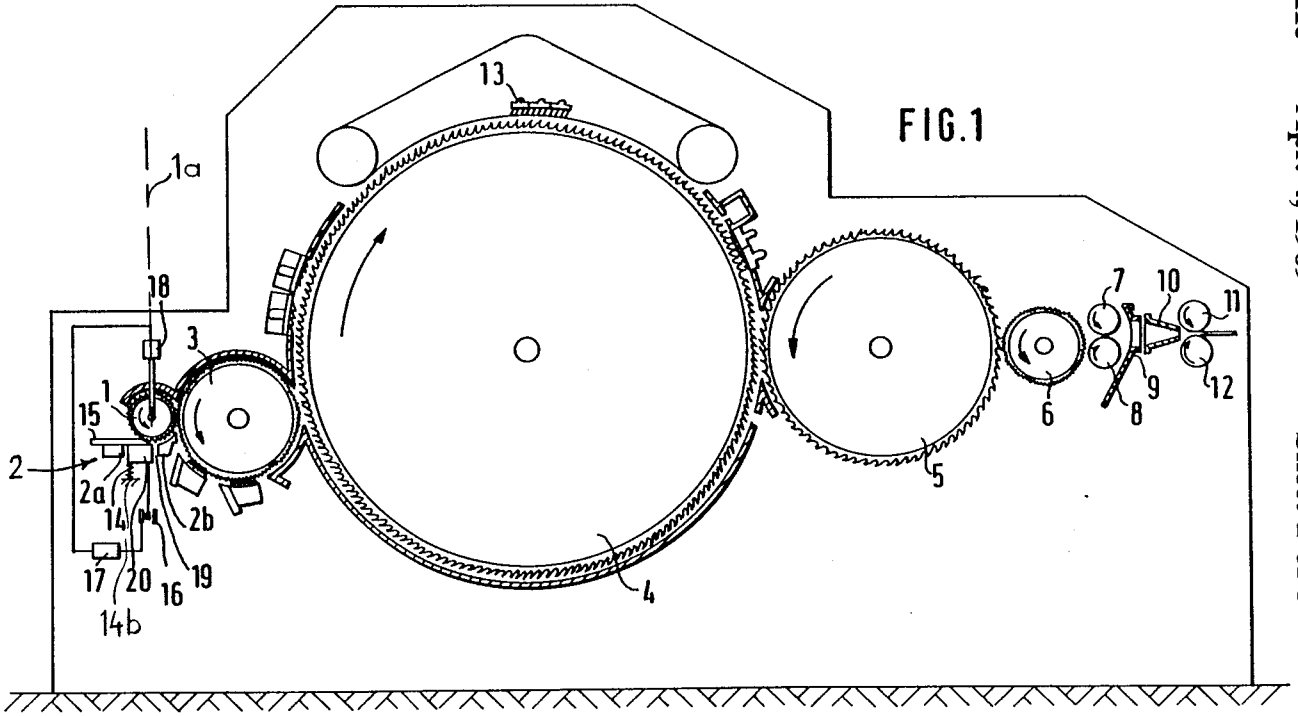
FIG. 1 is a schematic side elevational view of a carding machine incorporating the invention.

Turning to FIG. 1, there is illustrated therein a carding machine which may be, for example, an "EXACTACARD DK 715" model, manufactured by Trützschler GmbH & Co. KG, Mönchengladbach, Federal Republic of Germany. The carding machine has a feed roller 1, a feed table 2 formed by parts 2*a*, 2*b*, a licker-in 3, a main carding cylinder 4, a doffer 5, stripping rollers 6, crushing rollers 7 and 8, a web guide element 9, a sliver trumpet 10, calender rollers 11 and 12 as well as travelling flats 13.

The various cylinders and rollers of the illustrated carding machine normally rotate in the direction of the curved arrows drawn into the respective component. While the invention is shown and described in connection with a carding machine, it is to be understood that the invention may find application in other types of textile processing machines, such as roller card units, beaters, cleaners or the like.

Th feed roller 1 is stationarily supported for rotation. The feed table 2 is a one-piece component formed of a rearward portion 2*a* and a frontal portion 2*b*. Between the portions 2*a* and 2*b* there is provided a cutout 19. The terminal edge of the feed table portion 2*b* oriented towards the feed table portion 2*a* reaches slightly beyond the vertical axial plane 1*a* of the feed roller 1 in the direction of the feed plate portion 2*a*. The other, opposite end of the feed table portion 2*b* extends into a gap defined between the feed roller 1 and the licker-in 3. That end of the feed table portion 2*a* which is oriented towards the feed table portion 2*b* terminates at a short distance in front of the vertical axial plane 1*a* of the feed roller 1 as viewed in a direction towards the licker-in 3.

Below the feed roller 1 there is provided a sensor element 20 which is biased in the direction of the feed roller 1 by a compression spring 14 which is in engagement with the underside of the sensor element 20 and with a fixed countersupport 14*b*.

The sensor element 20 is movably supported—in a manner described later—for executing excursions as a function of the thickness of the fiber material 15 which passes through the space bounded by the sensor element 20 and the periphery of the feed roller 1. With the sensor element 20 there is associated a measuring member 16 which measures the displacements of the sensor element 20 and which applies its signals to a control device 17 which, in turn, is connected to a drive motor 18 of the feed roller 1. As the thickness of the running fiber lap varies, the sensor element 20, being in contact with the fiber lap surface, deflects accordingly. The magnitude of such deflection is registered by the measuring member 16 and a representative signal is applied to the control device 17 which, accordingly, causes the drive motor 18 for the feed roller 1 to rotate faster or slower.

Figure 2A:
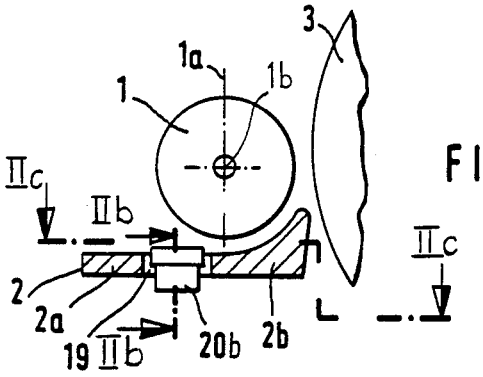
FIG. 2*a* is a schematic side elevational view of a preferred embodiment of the invention.

Turning to FIG. 2*a*, in the fiber lap feeding device formed of the feed roller 1 and the feed table 2 cooperating therewith, there is provided the feed table portion 2*a* over which the fiber material is guided towards the feed roller 1. The feed table 2, as well seen in FIG. 2*c*, is a one-piece construction and has two apertures formed as rectangular cutouts 19*a* and 19*b*. The long edges u′, u″ and v′, v″ of the cutouts 19*a* and 19*b*, respectively, are oriented parallel to the width of the feed table 2, that is, parallel to the axis 1*b* of the feed roller 1. The short edges x′, x″ and y′, y″ of the cutouts 19*a* and 19*b*, respectively, extend in the working direction, that is, parallel to the feed direction of the fiber lap 15. A sensor element 20*a* and 20*b* is accommodated in the area of the cutouts 19*a* and 19*b*, respectively. The sensor elements 20*a* and 20*b* have a rectangular configuration wherein, similarly to the edges of the cutouts 19*a* and 19*b*, the long sensor element edges extend parallel to the width dimension and the short sensor element edges are oriented in the working direction, that is, parallel to the direction of feed of the fiber material.

The frontal edge of each sensor element 20*a* and 20*b* extends approximately to the vertical axial plane 1*a* of the feed roller 1 as viewed in the direction towards the licker-in 3.

Figure 2B:
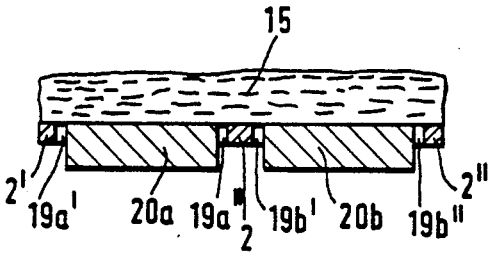
FIG. 2*b* is a sectional view taken along line II*b*—II*b* of FIG. 2*a*.
Figure 2C:
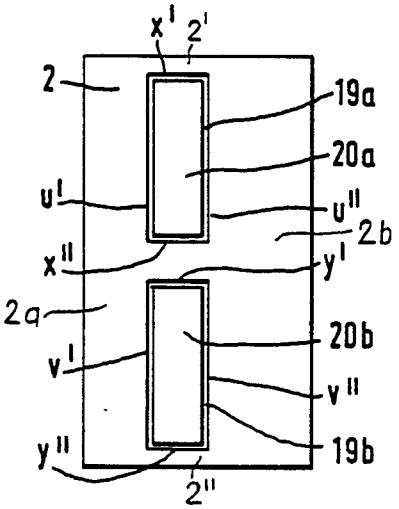
FIG. 2*c* is a top plan view taken along plane II*c*—II*c* of FIG. 2*a*.

Turning to FIG. 2*b*, the sensor elements 20*a* and 20*b* are illustrated in section and during sensing operation in the respective cutouts. The feed table 2 has narrow lateral bounding portions 2′ and 2″. The sensor element 20*a* projects through the cutout 19*a* while defining bilateral gaps 19*a*′ and 19*a*″ therewith. The sensor element 20*b* projects through the cutout 19*b* while defining bilateral gaps 19*b*′ and 19*b*″ therewith. The fiber lap 15 is supported on the feed table 2 and is in a contacting relationship with the respective upper faces of the sensor elements 20*a*, 20*b*.

The sensor elements 20*a* and 20*b* are of identical construction, and in FIGS. 3, 3*a*, 3*b*, 4, 5 and 6 a single sensor element designated with the reference numeral 20 will be described in more detail.

Turning to FIG. 3, the sensor element 20 is supported in a holding bar 21 by means of a pin-like extension 22 situated at one end thereof. The long narrow side of the sensor element 20 oriented towards the holding bar 21 is provided with a blind bore which receives a ball bearing 23 into which extends the end portion of the pin 22 of the holding bar 21. By virtue of this arrangement the sensor element 20 is pivotally supported for swinging motions about the generally horizontal axis of the support pin 22 as indicated by the double-headed curved arrow A.

The holding bar 21, in turn, is pivotally supported in a stationarily held bearing 23' providing for a pivotal motion of the holding bar 21 as indicated by the curved double-headed arrow B about a generally horizontal axis oriented perpendicularly to the axis of the pivot pin 22. By virtue of the swinging motion of the holding bar 21, the sensor element 20 is movable in a vertical plane as indicated by the double-headed arrow C.

Turning to FIG. 3*a*, the holding bar 21 is, at its end remote from the pin 22, engaged at its top by a compression spring 24 which is supported stationarily and which urges the assembly formed of the sensor element 20 and the holding bar 21 clockwise about the horizontal axis of the bearing 23'. With the holding bar 21 there is associated a measuring element 16 which is formed of a stationary plunger coil 16" and a plunger core (armature) 16' affixed to the holding bar 21 and is thus movable within and with respect to the plunger coil 16". The measuring element 16 thus constitutes an inductive, no-contact path sensor/distance measuring device. A stationary abutment 21' is provided above the holding bar 21 to limit the pivotal motion of the assembly 20, 21 in a clockwise direction to thus prevent the sensor element 20 to contact the periphery of the feed roller 1.

Further, as shown in FIG. 3*b*, at the two longitudinal opposite ends of the sensor element 20 further measuring elements 16*a* and 16*b* are arranged which may structured identically to the measuring element 16.

Figure 4:
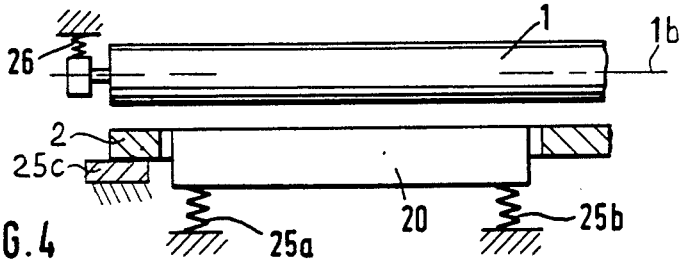
FIG. 4 is a schematic front elevational view of another preferred embodiment of the invention.

Turning to the embodiment illustrated in FIG. 4, the sensor element 20 is supported on the underside at its opposite longitudinal ends by compression springs 25*a*, 25*b* and the feed table 2 is rigidly held at 25*c*. Further, the feed roller 1 has bearing which is resiliently supported at the machine frame by means of a spring 26 whereby the feed roller 1 may execute vertical excursions.

Figure 5:
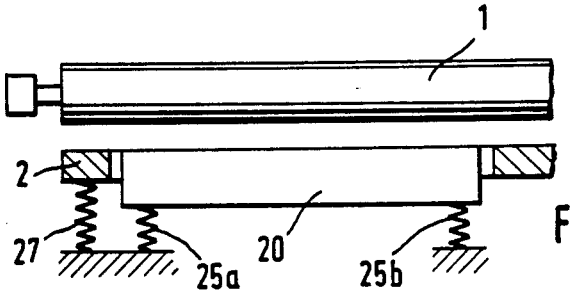
FIG. 5 is a schematic front elevational view of still another preferred embodiment of the invention.

In the embodiment illustrated in FIG. 5, the feed roller 1 is radially immovably supported while the feed table 2 is, at opposite sides, mounted resiliently by means of springs 27 (only one shown) to thus permit the feed table 2 to execute vertical excursions towards and away from the feed roller 1. The sensor element 20 is supported by springs 25*a* and 25*b* similarly to the embodiment shown in FIG. 4. Thus, while the feed table 2 and the sensor element 20 are caused to perform excursions by the same source of force (namely, the radially oriented force transmitted by the fiber material passing between the feed roller 1 on the one hand and the feed table 2 and the sensor element 20, on the other hand), the feed table 2 and the sensor element 20 are arranged to be movable independently from one another.

Figure 6:
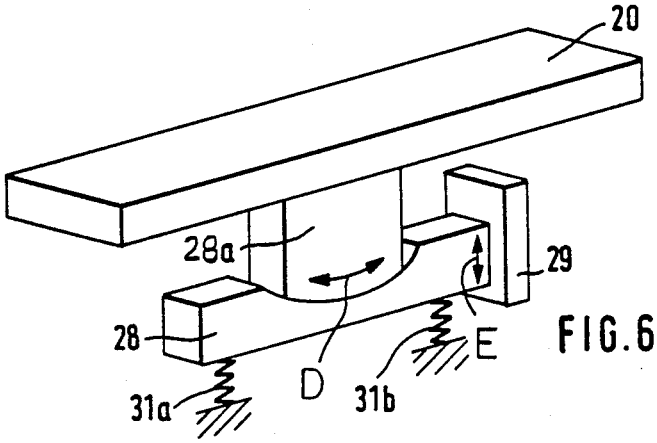
FIG. 6 is a schematic perspective view of yet another preferred embodiment of the invention.

Turning to the embodiment illustrated in FIG. 6, the sensor element 20 shown therein has in the mid portion of its underside a support post 28*a* whose free outer end remote from the sensor element 20 has an arcuate, convex configuration. A carrier bar 28, supported at its underside on springs 31*a*, 31*b*, has an upper concave, cradle-like supporting surface which receives the complementally configured convex face of the support post 28*a* of the sensor element 20 and is supported thereon for arcuate sliding motions indicated by the double-headed curved arrow D. The support bar 28, guided by vertical guides 29 on both ends of the support bar 28 (only one guide 29 is shown for clarity) is adapted to reciprocate vertically as indicated by the double-headed arrow E.

Figures 7, 7A, 7B:
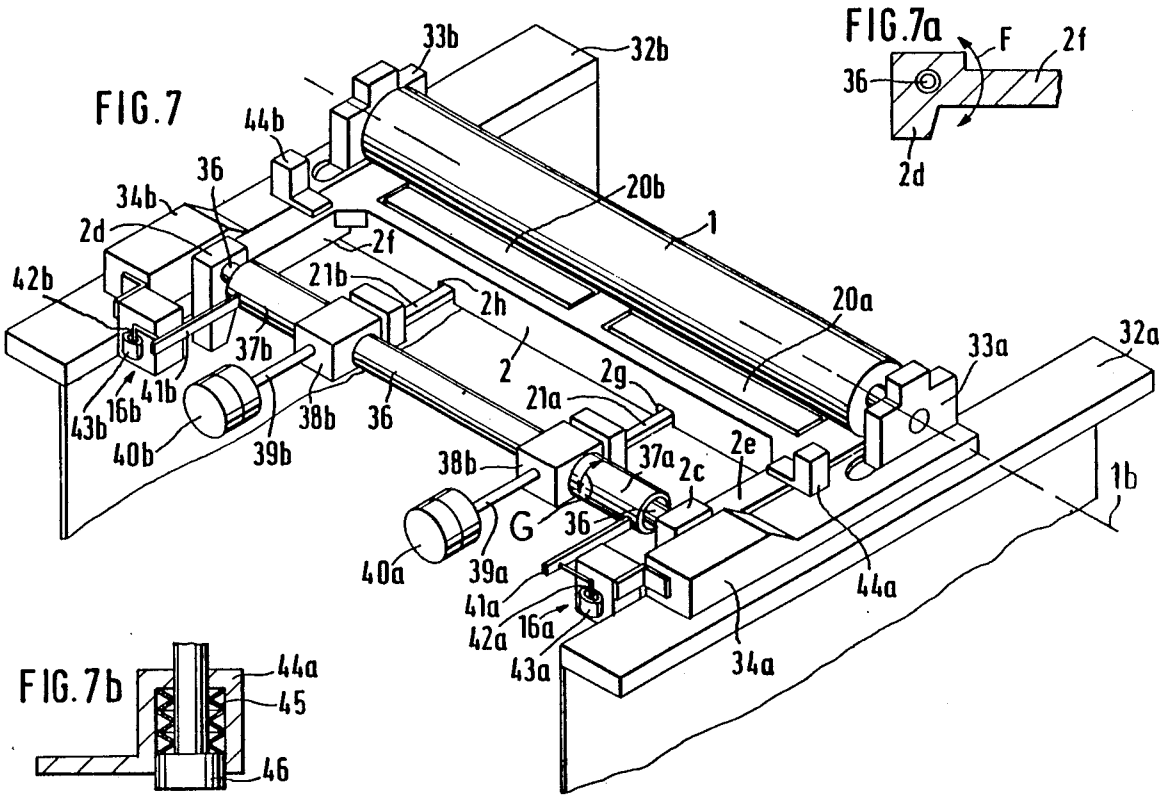
FIG. 7 is a perspective view of still another preferred embodiment of the invention.
FIGS. 7*a* and 7*b* are sectional details of the construction illustrated in FIG. 7.

Turning now to FIG. 7, the structural embodiment shown therein illustrates the feed roller 1 rotatably supported in two bearings 33*a*, 33*b* mounted on machine stand walls 32*a*, 32*b*, respectively. The feed table 2 is supported by two bearings 34*a*, 34*b* with the intermediary of two two-part connecting pieces 2*c*, 2*e* and 2*d*, 2*f*, respectively. As shown in FIG. 7*a*, the feed table 2, by virtue of its support in bearings 34*a*, 34*b* is swingable in a vertical plane about a horizontal axis oriented parallel to the axis 1*b* of the feed roller 1 as indicated by the curved arrow F in FIG. 7*a*. The bearings 34*a* and 34*b* are connected to one another by a rigid, stationary shaft 36.

The shaft 36 is spacedly and coaxially surrounded at its opposite end portions by sleeves 37*a*, 37*b* which are rotatable about and with respect to the shaft 36 as indicated by the arrow G. The sleeves 37*a*, 37*b* are connected with respective holding blocks 38*a*, 38*b* which support respective lever arms 39*a* and 39*b* whose outer end holds respective counter weights 40*a* 40*b*. To the holding blocks 38*a*, 38*b*, at their side oriented away from the lever arms 39 *a*, 39*b* there are attached holding bars 21*a*, 21*b* which pass through a rear side aperture 2*g*, 2*h* of the feed table 2. At the ends of the holding bars 21*a*, 21*b*, the respective sensor elements 20*a*, 20*b* are rotatably mounted to be swingable about a horizontal axis as illustrated in FIG. 3 and indicated with the arrow A. At the outside face of the sleeves 37*a*, 37*b* there is attached a respective measuring arm 41*a*, 41*b* connected with an armature 42*a*, 42*b* of a measuring member 16*a*, 16*b*, respectively. Each armature 42*a*, 42*b* cooperates with an associated plunger coil 43*a*, 43*b*. On the upper sides of the bearing connecting members 2*e*, 2*f* there is secured a respective hollow support element 44*a* 44*b*, which, as illustrated in FIG. 7*b*, accommodates respective disc spring stacks 45 and guide pins 46. This arrangement provides that the feed table 2 is resiliently supported by the support elements 44*a*, 44*b* on the top face of the housing block of the bearing members 34*a*, 34*b*.

Thus, according to the embodiment illustrated in FIG. 7, similarly to the embodiment schematically shown in FIG. 5, the feed table is movable. The purpose of such mobility is to achieve a possibly uniform pressing of the running fiber material against the feed roller 1 even in case of thickness fluctuations thereof. The pressing force is high and is necessary for a positive material feed and for clamping the fiber material advanced to the edge of the work zone, that is, to the transfer location between the feed roller 1 and the licker-in 3. Such a clamping prevents the licker-in 3 from tearing out large chunks of fiber material from the advanced fiber lap portion. The clamping determines the magnitude of the pressing force; the advancing of the material in response to such a force is of secondary significance. From the point of view of advancing the fiber material such pressing force could be of lesser value. The pressing arrangement between the feed table 2 and the feed roller 1 does not serve for the thickness determination. In the FIG. 7 embodiment the feed roller 1 is stationarily supported, that is, it is prevented from executing radial excursions. The sensor elements 20*a*, 20*b* are, for performing their sensing function, pressed against the feed roller 1 only with a very small force.

Such force does not serve for advancing the fiber material; on the contrary, it tends to counteract such transporting force. It is for this reason that the pressing force is as weak as possible and is just sufficient to ensure an unequivocal thickness sensing.

The arrangement of FIG. 7 thus ensures a structural separation between clamping and feeding the fiber material, on the one hand and sensing its thickness, on the other hand, to achieve an optimal dimensioning of forces for the two different purposes which, as explained above, require considerations inconsistent with one another. In this manner the individual tasks (particularly the clamping of the fiber material at the edge of the working zone and the sensing of the thickness of the material) may be separately handled and the necessary tasks performed in a more efficient manner. As a result, a highly sensitive determination of the thickness variation of the running fiber material may be achieved which is not feasible in case the function of material advancing and sensing are combined.

It will be understood that the above description of the present invention is susceptible to various modifications, changes and adaptations, and the same are intended to be comprehended within the meaning and range of equivalents of the appended claims.

What is claimed is:

1. In a textile fiber processing machine including a feed roller having a generally horizontal longitudinal axis and a feed table cooperating with the feed roller by defining therewith a nip through which the fiber lap passes; said feed table having a width extending parallel to said axis; a motor connected with the feed roller for rotating the feed roller; a fiber processing roller adjoining said feed roller and said feed table and being arranged to receive the fiber lap as it emerges from said nip; and an apparatus for levelling the thickness of the running fiber lap; said apparatus including a lap thickness measuring means including a sensor element cooperating with a surface of said feed roller and undergoing excursions in response to thickness variations of the fiber lap running between the feed roller and the sensor element; and a control device connected to said measuring means for receiving, from said measuring means, signals representing said excursions; said control device being connected to said motor for applying rpm control signals thereto as a function of said thickness variations; the improvement wherein said sensor element is separate from, and is movable relative to, said feed table; said feed table having an aperture and said sensor element cooperating with said feed roller through said aperture.

2. An apparatus as defined in claim 1, wherein said aperture is formed by a cutout in said feed table.

3. An apparatus as defined in claim 1, wherein said aperture has the shape of a rectangle having long edges extending parallel to said axis.

4. An apparatus as defined in claim 3, wherein said sensor element has the shape of a rectangle having long edges extending parallel to said axis and short edges extending parallel to a direction of material feed.

5. An apparatus as defined in claim 1, wherein said sensor element is present in a plurality of two to four.

6. An apparatus as defined in claim 1, wherein said sensor element has, as viewed in a running direction of the fiber lap, a downstream terminal edge oriented transversely to the running direction; said terminal edge extending approximately to a vertical axial plane of said feed roller, on an upstream side of said plane.

7. An apparatus as defined in claim 6, wherein said terminal edge is situated upstream of said vertical axial plane.

8. An apparatus as defined in claim 1, further comprising a stationarily held bearing supporting said sensor element for pivotal motion.

9. An apparatus as defined in claim 8, further comprising a force-exerting means urging said sensor element towards said feed roller.

10. An apparatus as defined in claim 1, further comprising a bearing supporting said sensor element for motion in a generally vertical direction.

11. An apparatus as defined in claim 1, wherein said sensor element has opposite ends spaced parallel to said longitudinal axis of said feed roller; further comprising springs connected to said opposite ends and being arranged for resiliently supporting said sensor element.

12. An apparatus as defined in claim 1, further comprising a holding bar carrying said sensor element and a bearing movably supporting said holding bar.

13. An apparatus as defined in claim 12, wherein said bearing supports said holding bar for a pivotal motion in a generally vertical plane about a first axis.

14. An apparatus as defined in claim 13, further comprising pivot means pivotally connecting said sensor element to said holding bar for pivotal motion of said sensor element in an approximately vertical plane about a second axis generally perpendicular to said first axis.

15. An apparatus as defined in claim 12, further comprising a counterweight operatively connected to said holding bar for urging said sensor element towards said feed roller.

16. An apparatus as defined in claim 1, wherein said lap thickness measuring means further comprises an inductive measuring element operatively connected to said sensor element and including a plunger coil and a plunger armature cooperating therewith.

17. An apparatus as defined in claim 16, wherein said lap thickness measuring means further comprises a measuring element operatively connected to said sensor element and being formed by an analog distance sensing device.

18. An apparatus as defined in claim 1, further comprising means supporting said feed roller for radial displacements thereof and means for rigidly supporting said feed table.

19. An apparatus as defined in claim 1, further comprising an abutment means cooperating with said sensor element for preventing said sensor element from moving closer to said feed roller than predetermined distance therefrom.

20. An apparatus as defined in claim 1, further comprising means for stationarily supporting said feed roller and means supporting said feed table for movements thereof towards and away from said feed roller.

21. An apparatus as defined in claim 20, wherein said means for supporting said feed table includes a spring arranged for resiliently urging said feed table towards said feed roller.

* * * * *